US010255880B1

(12) United States Patent
Herf et al.

(10) Patent No.: US 10,255,880 B1
(45) Date of Patent: Apr. 9, 2019

(54) COORDINATED ADJUSTMENT OF DISPLAY BRIGHTNESS

(71) Applicant: F.lux Software LLC, Los Angeles, CA (US)

(72) Inventors: Michael Herf, Los Angeles, CA (US); Lorna Herf, Los Angeles, CA (US)

(73) Assignee: F.lux Software LLC, Los Angeles, CA (US)

( * ) Notice: Subject to any disclaimer, the term of this patent is extended or adjusted under 35 U.S.C. 154(b) by 0 days.

(21) Appl. No.: 15/265,133

(22) Filed: Sep. 14, 2016

Related U.S. Application Data

(60) Provisional application No. 62/218,499, filed on Sep. 14, 2015.

(51) Int. Cl.
*G09G 5/02* (2006.01)
*G09G 5/10* (2006.01)

(52) U.S. Cl.
CPC ..... *G09G 5/10* (2013.01); *G09G 5/02* (2013.01); *G09G 2320/0653* (2013.01); *G09G 2320/0666* (2013.01); *G09G 2360/144* (2013.01)

(58) Field of Classification Search
CPC ..... H05B 33/0833; G09G 5/10; G09G 2320/0653; G09G 2320/0666
See application file for complete search history.

(56) References Cited

U.S. PATENT DOCUMENTS 5,874,988 A 2/1999 Gu
6,600,833 B1 7/2003 Tan
6,870,529 B1 3/2005 Davis
7,446,762 B2 11/2008 Hsieh et al.
(Continued)

FOREIGN PATENT DOCUMENTS

EP 1619648 1/2006
WO WO2011089540 7/2011
WO WO2016033099 3/2016

OTHER PUBLICATIONS

"Color correction," Wikipedia [online] Dec. 19, 2015 [retrieved on Mar. 28, 2016]. Retrieved from the Internet: <URL: https://en.wikipedia.org/wiki/Color_correction>, 3 pages.
(Continued)

*Primary Examiner* — Antonio A Caschera
(74) *Attorney, Agent, or Firm* — Fish & Richardson P.C.

(57) ABSTRACT

A computer-implemented method and includes identifying a change to be made in a brightness level of the light-generating appliance, the identifying of the change being effected by an input external to the light-generating appliance; determining, with a component of the light-generating appliance and in response to identifying the change to be made in the brightness level, a level of change to be made in a nonbrightness-related lighting output parameter of the light-generating appliance, to maintain a level of user stimulating light for a user visually exposed to the light-generating appliance, the level being equal as before the change in brightness level is made and after the change in brightness level is made; and changing the brightness level of the light-generating appliance according to the identified change in the brightness level, and changing the nonbrightness-related lighting output parameter based on the determined level of change to be made in the nonbrightness-related lighting output parameter.

33 Claims, 4 Drawing Sheets

(56) References Cited

U.S. PATENT DOCUMENTS

| | | | | |
|---|---|---|---|---|
| 7,840,067 | B2 | 11/2010 | Shen et al. | |
| 8,188,990 | B2 | 5/2012 | Zamorsky et al. | |
| 8,384,780 | B1 | 2/2013 | Frank et al. | |
| 8,436,556 | B2 * | 5/2013 | Eisele | H05B 33/0857 315/152 |
| 8,648,691 | B2 | 2/2014 | Zuo et al. | |
| 9,039,199 | B2 | 5/2015 | Asakawa | |
| 9,655,211 | B2 * | 5/2017 | Altamura | H05B 33/0821 |
| 2002/0008696 | A1 | 1/2002 | Wagner | |
| 2004/0130555 | A1 * | 7/2004 | Ko | G09G 5/02 345/589 |
| 2004/0165001 | A1 | 8/2004 | Wang | |
| 2004/0225340 | A1 | 11/2004 | Evans | |
| 2005/0134547 | A1 | 6/2005 | Wyatt | |
| 2006/0069794 | A1 | 3/2006 | Gorog | |
| 2006/0069894 | A1 | 3/2006 | Gorog et al. | |
| 2006/0152525 | A1 | 7/2006 | Woog | |
| 2007/0239837 | A1 | 10/2007 | Jablokov et al. | |
| 2007/0289182 | A1 | 12/2007 | Reinold et al. | |
| 2008/0033633 | A1 | 2/2008 | Akiyoshi et al. | |
| 2009/0016168 | A1 | 1/2009 | Smith | |
| 2010/0118403 | A1 | 5/2010 | Laitinen et al. | |
| 2010/0277076 | A1 | 11/2010 | Tracy et al. | |

OTHER PUBLICATIONS

"Color temperature," Wikipedia [online] Mar. 12, 2016 [retrieved Mar. 28, 2016]. Retrieved from the Internet: <URL: https://en.wikipedia.org/wiki/Color_temperature>, 16 pages.

"F.lux Review," My Morning Routine [online] Dec. 22, 2014 [retrieved on Mar. 28, 2016]. Retrieved from the Internet: <URL: http://mymorningroutine.com/flux-review/>, 2 pages.

"F.lux," Product Hunt [online] Jan. 6, 2014 [retrieved Mar. 28, 2016]. Retrieved from the Internet: <URL: https://www.producthunt.com/tech/f-lux>, 3 pages.

"Light-emitting e-readers before bedtime can adversely impact sleep." Brigham and Women's Hospital [online ] Dec. 22, 2014 [retrieved on Mar. 28, 2016]. Retrieved from the Internet: <URL:http://www.brighamandwomens.org/about_bwh/publicaffairs/news/pressreleases/PressRelease.aspx?PageID=1962 > 2 pages.

"Tungsten film," Wikipedia [online] Feb. 24, 2013 [retrieved on Mar. 28, 2016]. Retrieved from the Internet: <URL: https://en.wikipedia.org/wiki/Tungsten_film>, 1 page.

"Wratten number," Wikipedia [online] Jun. 24, 2015 [retrieved on Mar. 28, 2016]. Retrieved from the Internet: <URL: https://en.wikipedia.org/wiki/Wratten_number>, 7 pages.

Bakalar, "How E-books may disrupt your sleep," well.blogs.nytimes.com [online] Dec. 22, 2014 [retrieved Dec. 22, 2014]. Retrieved from the Internet: <URL: http://well.blogs.nytimes.com/2014/12/22/e-books-may-interfere-with-sleep/?_r=1>, 2 pages.

Beil, "In Eyes, a Clock Calibrated by Wavelengths of Light," The New York Times [online] Jul. 4, 2011 [retrieved on Mar. 28, 2016]. Retrieved from the Internet: <URL: http://www.nytimes.com/2011/07/05/health/051ight.html?_r=0>, 5 pages.

Braga, "The Story Behind f.lux, the Night Owl's Color-Shifting Sleep App of Choice," Motherboard [online] Jan. 21, 2016 [retrieved on Mar. 28, 2016]. Retrieved from the Internet: <URL: http://motherboard.vice.com/read/the-story-behind-flux-the-night-owls-color-shifting-sleep-app-of-choice>, 11 pages.

Chang et al., "Evening use of light-emitting eReaders negatively affects sleep, circadian timing, and next-morning alertness," *Proc Natl Acad Sci U S A.,* 112(4):1232-1237, Epub Dec. 22, 2014.

Charity, "What color is a blackbody?—some pixel rgb values" http://www.vendian.org/mncharity/dir3/blackbody/, Jun. 2001, 3 pages.

Falbe et al., "Sleep duration, restfulness, and screens in the sleep environment," *Pediatrics,* pii: peds.2014-2306, Epub. Jan. 5, 2015.

Gooley et al., "Exposure to room light before bedtime suppresses melatonin onset and shortens melatonin duration in humans," *J Clin Endocrinol Metab.,* 96(3):E463-E472, Epub Dec. 30, 2010.

Hoebee, "F.lux: the favorite application on my PC," Dick Hoebee [online] Jul. 14, 2015 [retrieved on Mar. 28, 2016]. Retrieved from the Internet: <URL: http://dickhoebee.com/2015/07/flux/>, 4 pages.

Holzman, "What's in a color? The unique human health effect of blue light," *Environ Health Perspect.,* 118(1):A22-A27, Jan. 2010.

Inhofer, "Color Grading vs. Color Correction: What's the Difference? " Lynda [online] Jul. 2, 2015 [retrieved on Mar. 28, 2016]. Retrieved from the Internet: <URL: http://www.lynda.com/articles/color-grading-vs-color-correction>, 5 pages.

Jragar, "Take Back Your Sleep Pattern: f.lux Review," GMR tec [online] Feb. 8, 2016 [retrieved on Mar. 28, 2016]. Retrieved from the Internet: <URL: http://www.gmrtec.com/index.php/2016/02/08/take-back-your-sleep-pattern-f-lux-review/>, 9 pages.

Kabbani, "f.lux App Review: Why this is a must have app!" SwolePT [online] 2013. Retrieved from the Internet: <URL: http://www.swolept.com/posts/why-you-need-to-install-f-lux-free-app-review#.Vv1DuU32a72>, 8 pages.

Kim, "Blue light from electronics disturbs sleep, especially for teenagers," The Washington Post [online] Sep. 1, 2014 [retrieved on Mar. 28, 2016]. Retrieved from the Internet: URL: https://www.washingtonpost.com/national/health-science/blue-light-from-electronics-disturbs-sleep-especially-for-teenagers/2014/08/29/3edd2726-27a7-11e4-958c-268a320a60ce_story.html>, 4 pages.

Mann, "F.lux Review: The Software That Makes You Sleep Better," Sleep Junkies [online] Dec. 4, 2012 [retrieved on Mar. 28, 2016]. Retrieved from the Internet: URL: http://sleepjunkies.com/tools/flux-app-review/, 13 pages.

Mantiuk et al., "Display Adaptive Tone Mapping—Supplementary Materials," *ACM Transactions On Graphics* (Proc. of SIGGRAPH), 2008, 3 pages.

Mantiuk et al., "Display Adaptive Tone Mapping," *ACM Transactions on Graphics* (Proc. of SIGGRAPH '08) 27 (3), article No. 68, 2008, 10 pages.

Pash, "F.lux Changes Your Screen Brightness by Time of Day," Lifehacker [online] Feb. 23, 2009 [retrieved on Mar. 28, 2016]. Retrieved from the Internet: <URL: http://lifehacker.com/5158832/flux-changes-your-screen-brightness-by-time-of-day>, 2 pages.

Robinson, "This app has transformed my nighttime computer use," Tech Insider [online] Oct. 28, 2015 [retrieved on Mar. 25, 2016]. Retrieved from the Internet: <URL: http://www.techinsider.io/flux-review-2015-10>, 6 pages.

Schifreen, "A Reminder: If You Use Windows, Just Get Flux," Gizmo's Freeware [online] Jan. 13, 2015, [retrieved on Mar. 25, 2016]. Retrieved from the Internet: <URL: http://www.techsupportalert.com/content/reminder-if-you-use-windows-just-get-flux.htm>, 6 pages.

Searing, "Sleep troubles? Maybe electronic devices are interfering with bedtime," washingtonpost.com [online] Jan. 5, 2015 [retrieved on Jan. 7, 2015]. Retrieved from the Internet: <URL: http://www.washingtonpost.com/national/health-science/sleep-troubles-maybe-electronic-devices-are-interfering-with-bedtime/2015/01/05/0ca0ebd8-905e-11e4-ba53-a477d66580ed_story.html>, 4 pages.

Smith, "This free app makes reading a computer screen at night much easier," Business Insider [online] Mar. 25, 2013 [retrieved on Mar. 28, 2016]. Retrieved from the Internet: <URL: http://www.businessinsider.com/flux-software-helps-ease-your-eyes-2013-3>, 3 pages.

The Lifehacker Staff, "The 50 Free Apps We're Most Thankful For," Lifehacker [online] Nov. 16, 2015 [retrieved on Mar. 28, 2016]. Retrieved from the Internet: <URL: http://lifehacker.com/5962588/the-50-free-apps-were-most-thankful-for>, 35 pages.

Turnbull, "50 Mac Essentials #13: Flux," Cult of Mac [online] Sep. 20, 2010 [retrieved on Mar. 25, 2016]. Retrieved from the Internet: <URL: http://www.cultofmac.com/59821/50-mac-essentials-13-flux/>, 15 pages.

Vanhemert, "The UI inventions we want to see in 2015," wired.com [online] Jan. 6, 2015 [retrieved on Jan. 7, 2015]. Retrieved from the Internet: <URL: http://www.wired.com/2015/01/ui-inventions-want-see-2015/?mbid=social_twitter>, 5 pages.

Wernick, "Losing sleep? Blame your favorite electronic device," Public Radio International [online] Jan. 27, 2015 [retrieved Mar. 28, 2016]. Retrieved from the Internet: <URL: http://www.pri.org/stories/2015-01-27/losing-sleep-blame-your-favorite-electronic-device>, 7 pages.

(56) References Cited

OTHER PUBLICATIONS

Wikipedia, "f.lux," Wikipedia [online] Mar. 11, 2016 [retrieved on Mar. 25, 2016]. Retrieved from the Internet: <URL: https://en.wikipedia.org/wiki/F.lux>, 3 pages.
Woods, "F.lux finally comes to Android to save your eyes," The Next Web [online] Mar. 15, 2016 [retrieved on Mar. 28, 2016]. Retrieved from the Internet: <URL: http://thenextweb.com/apps/2016/03/15/f-lux-automatically-controls-androids-screen-reduce-strain-eyes/%20-%20gref/>, 4 pages.
Yurek, "Apple CEO Tim Cook talks color quality at Goldman Sachs conference," Nanosys [online] Feb. 13, 2013 [retrieved on Mar. 28, 2016]. Retrieved from the Internet: <URL: http://www.nanosysinc.com/dot-color-archive/2013/02/13/apple-ceo-tim-cook-talks-color-quality-at-goldman-sachs-conference> 4 pages.
Zukerman, "Review: f.lux makes your computer usable at night," PC World [online] Oct. 31, 2013 [retrieved on Mar. 28, 2016]. Retrieved from the Internet: <URL: http://www.pcworld.com/article/2056895/review-f-lux-makes-your-computer-usable-at-night.html>, 8 pages.

* cited by examiner

COORDINATED ADJUSTMENT OF DISPLAY BRIGHTNESS

CROSS-REFERENCE TO RELATED APPLICATIONS

This application claims priority to U.S. Provisional Application Ser. No. 62/218,499, filed on Sep. 14, 2015, the entire contents of which are hereby incorporated by reference.

TECHNICAL FILED

This document generally describes technology related to generating illumination, including in the improvement of computer operation for generating illumination.

BACKGROUND

The effect of light on sleep patterns is roughly understood—with studies showing that the timing of, and quality of, light that excites a person's senses can have a very real effect on the person's ability to get to sleep quickly at night, and to have quality sleep. For example, students who use portable electronic devices before bedtime tend to get substantially less sleep than those who do not.

Such light can affect a person's production of melatonin, a hormone that anticipates the daily onset of darkness. Melatonin is used to synchronize circadian rhythms of physiological functions that include sleep timing, blood pressure, and seasonal reproduction. Released by the pineal gland starting a couple hours before ordinary sleeping time, melatonin reduces alertness and makes sleep more inviting. Jet lag is one example of problems created by a mismatch between a person's external environment and circadian phase—where the person's local time zone changes, and his or her lighting situation does not match his or her pattern for melatonin release. And it is light, particularly from the cool (blue) end of the color spectrum and typically produced by electronic devices like laptops and tablets, that can keep the pineal gland from releasing melatonin. The effects can be particularly serious for teenagers, whose circadian rhythms are already shifting (and out of alignment with normal societal sleep timing) due to their aging, and who are very likely to use portable computing devices that are often held very close to the face.

A person's production of melatonin can be affected positively by varying the color temperature of light presented to the person, such as by changing the color of light bulbs or computer displays toward the warmer (red) end of the color spectrum in the evening.

SUMMARY

This document generally describes computer-based technology for affecting the level of stimulating light received by a user of various light-producing appliances, such as light bulbs and computers (e.g., desktops, laptops, tablets, and smartphones). Such management of stimulating light can be used to better manage a person's circadian rhythms so as to better enable them to fall asleep at an appropriate time, so that they get a good night's rest. It may also be used in appropriate circumstances to ensure that they stay awake, such as when they are performing a job that requires alertness for maximum safety.

For example, as described in more detail below, various aspects of light-producing appliances can be controlled in coordination with other aspects, such as by coordinating various parameters of a computer display or tunable light fixture with changes in brightness of such an appliance. For example, increases in brightness may produce greater stimulating light, so an accompanying change in overall color temperature to a warmer end of the spectrum can be made so as to offset, at least partially, the effect created by the change in brightness. The particular levels of change in one or more parameters may be configured so as to provide a desired overall level of stimulating light for the user over a time period, such as over the course of an entire day (one circadian cycle), or over a period determined to have a material effect on a person's ability to get to sleep at a proper hour, such as starting several hours before that bed time, or starting at a time relative to dusk (when natural visual stimulation ceases). Such a desired level may be a generally consistent level, so that an external input to a device relating to one parameter (e.g., a change in screen brightness), may result in the computation and effecting of an offsetting change in another parameter, so that the melanopic effect on the user of the device does not change, or is maintained at a value (that may be updated over time) determined to keep the melanopic level flat for before and after the change.

The level of melanopic effect may be measured and/or computed at the eyes of a user of a device, and may include light from the device, light from other devices, and ambient light. Such measurement may be made via sensors placed near the user's eyes (e.g., in the front surface of a pair of electronic glasses worn by the user) or aimed toward the user's eyes and/or face. For example, a light sensor may measure light levels reflecting off a user's eyes and/or skin and use such sensed values to compute the melanopic effect in various manners for the user. The effect received by the user may also be computed, such as by measuring or assuming a distance from a device screen to the user's face/eyes, and determining an amount of the light that will likely hit the user's eyes, plus perhaps additional ambient light which may be computed by starting with an ambient light sensor on the device.

Such adjustments may be made with brightness as the dependent variable or the independent variable, and color temperature or other parameters as independent or dependent variables, and may involve coordinated adjustment of both tunable light fixtures and computer displays in coordination with each other. For example, one resident of a house may manually increase the brightness in a room via a light switch slider, and computing devices of other people in the room may sense such a change and adjust to a warmer color palette to counter some of the effect of the brighter room lights (though a user may lock their color temperature from being automatically changed if, for example, they are in a digital image editing application). In such example, brightness is the independent variable that is compensated for using other dependent variables. In another example, a user may be working on a laptop and determine that the colors do not appear accurate. The user may adjust the overall color of the computer display (e.g., by selecting a choice to return their display from adjusted color temperature to "accurate" colors), and the computer may then lower or raise the display brightness to compensate for the change in stimulating light level created by the color temperature adjustment. In coordination, a computer that controls lighting in the room may change the color temperature of one or more light fixtures, or actuators on window blinds may be powered so as to open or close the blinds, so as to further achieve a level of desired light stimulation for one or more people in the room.

In one implementation, a computer-implemented method for controlling display of a light-generating appliance is disclosed. The method comprises identifying a change to be made in a brightness level of the light-generating appliance, the identifying of the change being effected by an input external to the light-generating appliance; determining, with a component of the light-generating appliance and in response to identifying the change to be made in the brightness level, a level of change to be made in a nonbrightness-related lighting output parameter of the light-generating appliance, to maintain a level of user stimulating light for a user visually exposed to the light-generating appliance, the level being equal as before the change in brightness level is made and after the change in brightness level is made; and changing the brightness level of the light-generating appliance according to the identified change in the brightness level, and changing the nonbrightness-related lighting output parameter based on the determined level of change to be made in the nonbrightness-related lighting output parameter. The change to be made in the brightness level can be identified in response to a manual user input to change a brightness level of the light-generating appliance, and/or from an ambient brightness level sensed by a sensor that corresponds to the light-generating appliance.

In certain aspects, the light-generating appliance comprises a display of a computer and the nonbrightness-related lighting output parameter is an overall color temperature of the display. The change to be made in the brightness level can then be identified in response to determining that a particular type of software application is, or is going to be, a focus on the display. Also, the level of change to be made in the overall color temperature level of the display is a function of an amount of stimulating light that a user of the electronic device has been determined to have received during a current day. In some aspects, the amount of stimulating light that the user of the light-generating appliance has been determined to have received during the current day comprises stimulating light from the light-generating appliance and stimulating light from sources other than the light-generating appliance. Moreover, the light-generating appliance can be a computer and the sources other than the light-generating appliance can comprise natural and artificial ambient light. The natural and artificial ambient light can also be sensed by a sensor that is part of the computer. In addition, the computer can make a determination whether an ambient light source is natural or artificial by analyzing one or more characteristics of the light sensed by the sensor, and provides a result of the determination to a sub-system for determining the level of change to be made in the overall color temperature level of a display of the computer.

In yet other aspects, the light-generating appliance is a computer display, and as a result of determining that the brightness level of the display has gotten brighter, changing an overall color temperature of the display to a warmer color temperature than before the change to be made in the brightness level was identified. Moreover, the method can include selecting a speed, from multiple available speeds, with which the change in brightness level is made. The speeds selected for dimming the display can be faster than speeds selected for brightening the display. Also, the determined level of change to be made in the overall color temperature of the display can be made using a numeric model of a manner in which the display provides stimulating light to viewers of the display. The change to be made in brightness can also be determined by the computer as a function of the level of change to be made in the overall color temperature of the display.

The systems and techniques just discussed may also be carried out using particular physical media or computer-implemented systems. For example, the actions discussed above may be carried out as operations by the execution of code that is stored on one or more tangible, non-transitory machine-readable media. In some implementations, such media is part of a system and is in operable communication with one or more computer processors that execute code to generate the operations.

In certain implementations, the systems and techniques discussed here may provide one or more advantages. For example, a system may adjust one or more appliances alone or in coordination to limit the amount of stimulating light levels a person or different people receive so as to allow them to have quicker and better sleep. Such adjustments may be announced to a user (e.g., by text on a computer display), as may instructions for other actions the user can take to help their sleep. The adjustments may also be incorporated as part of a much broader lighting-management suite for a user, including with the measuring of light levels around a user at many different times of day across a long time period (e.g., months), and aggregating such data from many different users (e.g., thousands of users) so as to identify trends and patterns in the light to which different people are subjected, and the effect of such light on the activities of such users. For example, light measurement can be combined with activity measurement (e.g., from a fitness band) and demographic information (e.g., age, race, and gender) and survey information provided by the various users (e.g., identifying how healthy they feel, whether they believe they obtain adequate sleep, etc.). Such combined information can be used by researchers, e.g., to develop better techniques to improve the sleeping health and general health of the users.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
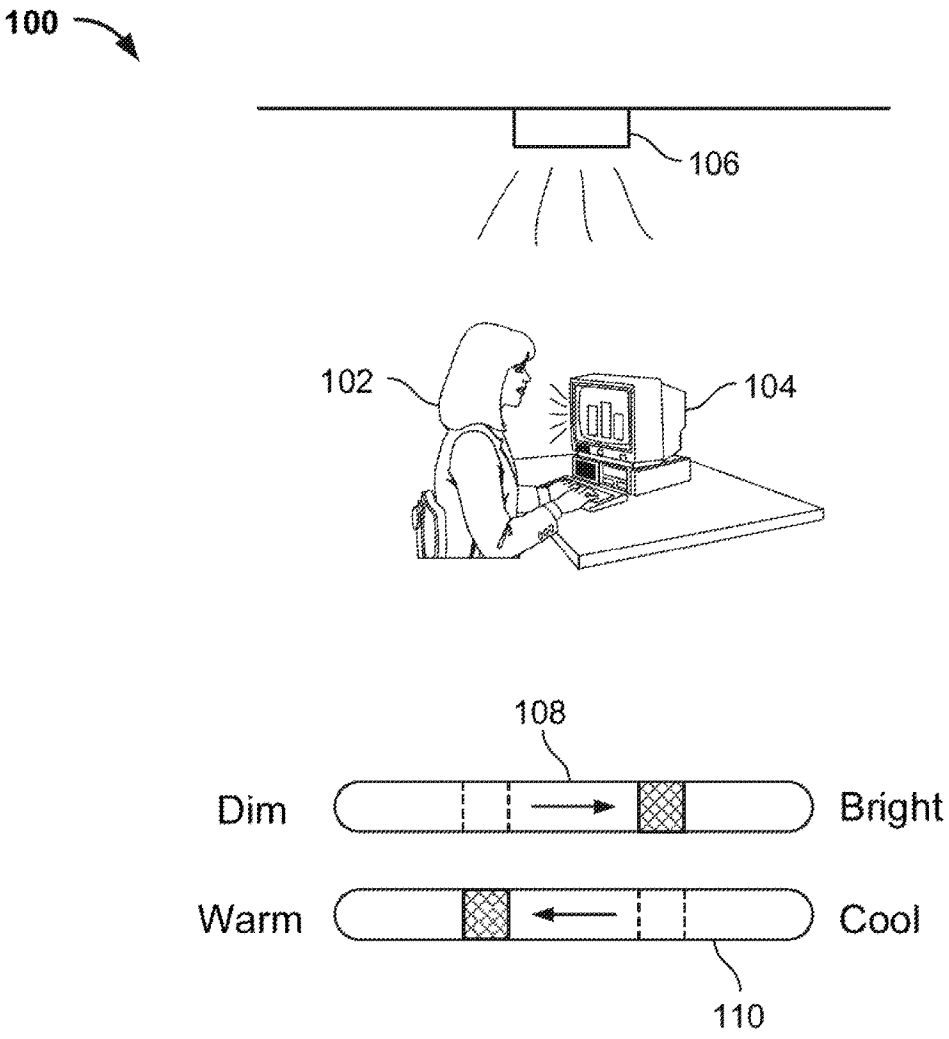
FIG. 1 is a conceptual diagram showing coordinated adjustment of multiple lighting parameters for a person.

This document generally describes computer-based systems and techniques that can be used to electronically coordinate multiple variables that play a role in affecting a person's circadian sleep rhythms. The most important of those variables relate to visual stimulation that a person receives over the course of a day, and particularly in the time just before their natural bedtime. Two main variables are the amplitude/brightness and color temperature of light to which a person is exposed.

In examples discussed below, the brightness level of a computer display may change, either as a result of a user manually changing the brightness, the computer sensing a change in ambient lighting and adjusting the display brightness accordingly, a user switching between applications (e.g., from a relatively dark book reader to a relatively bright videogame), or in other manners by which an external influence effects a change of the brightness level. An application on such computer (e.g., that is part of or an adjunct to the device's operating system) may identify the change in brightness and may make a corresponding change in overall color temperature for the display to compensate for melanopic, or circadian, effects of the brightness change. For example, if a user switched to a brighter application, the overall color temperature may be adjusted toward the warm end of the color spectrum so as to compensate for the extra brightness, so that the overall melanopic effect is unchanged as a result of the brightness change, or is changed less than if the offsetting adjustment were not made. The melanopic effect may be set to be a particular numeric setting level for light at the eye of the user, where the light at the user's eye may be measured directly using sensors near the eye and/or aimed toward the eye, or may be computed such as by considering ambient light levels plus a distance between a screen of the device and the user's eyes so as to determine the amount of the light leaving the device's display and traveling to the user's eyes.

The adjustments may be made with a goal of achieving and/or maintaining a particular melanopic effect. For example, the degree of overall color temperature change may be selected by the application to effectively totally offset the effect generated by the increase in brightness (where "overall" change is applied consistently across the display and consistently to multiple different items having multiple different colors, as opposed to simply changing colors of particular components, such as in changing a theme). Such adjustments may also be subject to particular limits—e.g., a certain color temperature may be determined (e.g., from overall testing with consumers or with a particular person providing a setting for his or her devices) that is the maximum permissible adjustment (either overall or at a particular step in adjustment), because going any further would be visually offensive. Thus, if the brightness is increased too far, the change to warmer colors as a compensation may only partially offset the melanopic effect of the brightness increase because any greater change in color temperature would be too jarring or too far from the norm.

Also, the adjustments may be made between multiple different kinds of light-generating appliances that a user is currently facing—including computers, televisions, and room lighting—and may also take into account light input from non-controllable sources, both artificial and natural. For example, a light sensor, or data about current time of day and cloud cover, may provide an indication of the natural light to which a person is currently subject (with assumptions about certain factors, such as typical size and transmissivity of windows in an office building), and a determination about a color temperature change for a computer (in response to a brightness change) may be reduced, out of an understanding that the computer is only one of multiple visual stimuli that the person is currently receiving.

By these general mechanisms then, a lighting-related change that affects a person can be identified as having occurred or about to occur, and one or more other light-related modifications can be made so as to achieve a desired melanopic effect for the person—as a combination of the initial chance and the other modifications. Generally, the desired melanopic effect may be directed at maintaining stimulating light to the person at a level that will allow the person to avoid being unduly stimulated by visual inputs leading up to a bedtime for the person—where excess visual stimulation is the amount determined to have an undue effect on time to sleep for the person. For example, as changes are made to a device that might affect the melanopic effect the device is providing (e.g., an external user input to adjust brought ness up or down, or a similar change effected by an ambient light sensor), corresponding changes can be made in other parameters so as to offset the first change, so that the melanopic effect is maintained at a constant level as compared to before and after the changes are made. The melanopic effect may be a particular level of light as generated by the device, or as measured at the user's eyes. For example, a determination can be made about how far the user's face is from a computer screen and a light level of the screen may be identified so as to determine the light level at the user's eyes (where ambient light conditions may additionally be considered).

FIG. 1 is a conceptual diagram showing coordinated adjustment of multiple lighting parameters for a person. In general, a system 100 is shown with respect to a user 102, and also shown is the conceptual ability to change multiple parameters relating to stimulating light delivered to the user 102.

In this example, user 102 is sitting in front of and facing display 104. Display 104 may be a desktop, laptop, smartphone, or other display that generates light as a mechanism to display textual and graphical information to the user 102. Display 102 may provide the light directly from the display of data or via a back-light mechanism whose light is then interfered with by intervening mechanisms. The display 104 may be driven by one or more microprocessor and one or more graphical processor units (GPUs) and may change over time as the content that is provided to display 104 changes—e.g., as a user interacts with one or more applications or as video provided on display 104 changes. Such light, which may be provided in a variety of colors for different areas of the display 104 may be received by the eyes of the user 102 (e.g., where an operating system window may be defined by lines of a particular color and a rectangular background of a contrasting color), and interpreted by the user's brain. The light may also have a stimulating effect on the user, by alerting to the melanopsin-containing retinal ganglion cells so as to affect the user 102.

A room light 106 is represented here as a ceiling light in a room of a building where the user 102 is located. The light 106 may be a fixed or static light whose brightness and color temperature cannot change (other than being turned on or off), can de dimmable in familiar manners (e.g., via wall-mounted slider switch or via mobile application and computer controller). The room light 106 can be a ceiling light, a floor lamp, a desk lamp, or other form of artificial electrically-powered light, and can be switched and otherwise controlled individually or in combination with other lights (e.g., when a room with multiple ceiling lights has them dimmed or brightened in coordination).

A pair of sliders 108, 110 is shown conceptually to represent two parameters for light generation that can be adjusted in coordination with each other. In actual implementation, additional other parameters may be involved or additional parameters may be involved, where one or more parameters may be independent parameters and one or more may be dependent parameters. In this situation, slider 108 represents a lighting intensity level of a light generating appliance such as a computer display 104 or a room light 106. It can act as an independent variable when a user 102 brightens or dims the lights in the room (e.g., via a wall switch or smartphone application) or brightens or dims the display 104 (e.g., via a key on a keyboard or a switch mounted to the display 104).

The other slider 110 represents an overall color temperature for the display 104, the light 106, or another light-generating appliance or appliances. Historically, color temperature is not a variable that has been as easily changed by a user 102 as has brightness, or intensity, so typically, the color temperature will be a dependent variable. However, user 102 may be provided opportunities to manually change the color temperature, such as by entering a configuration screen on a computer or by selecting to re-set the color temperature to an "accurate" temperature after a system has changed the color temperature to a less accurate setting, such as in an attempt to lower the amount of stimulating light being put out by the display 104.

In the illustration, slider 108 is shown as having been moved from a relatively dimmer setting to a relatively brighter setting. For example, user 102 may have decided that she could not adequately see materials on her display 104, and may have nudged a control for the brightness up slightly to make the content on display 104 easier for her to see well. Or someone may have entered a dim room where user 102 was working, and brightened the dimmable lights in the room slightly.

Slider 110 is shown conceptually as adjusting the overall color temperature of the display 104 and/or light 106 in response to the change in brightness, and in a direction toward the warm end of the spectrum. Such a change will cause the generated light to have less of a stimulating light effect, or melanoptic effect, on the user 102—and that lowering of effect may partially or fully offset the change cause by the adjustment to brightness (e.g., so that the change in melanopic effect becomes zero as a result of the change in brightness level). The change in color temperature may be made on the same appliance that changed its brightness or on another appliance. For example, the color temperature of the display 104 may be made warmer in response to detecting that the brightness of light 106 has changed (e.g., via light detector or via communication between a system that operates light 106 and a system that operates display 104). Or the temperature of light 106 may be changed in response to a change in brightness of light 106.

Melanopic lux describes how the melanopsin-containing cells in your retina react to light. These cells provide the major input to the circadian pacemaker at high light levels. At lower levels, and when things are changing, the cones appear to provide an important part of the response.

As some examples of color temperatures and lighting that may be controlled with the techniques discussed here, a computer screen may nominally be set at an overall color temperature of 2700K when at full backlight brightness. If a user selects a control to lower the backlight to 25% or a user enters a space and a light sensor on the computer causes the backlight to fall to 25% (or a combination of the two), the color temperature may be increased to 6500K. If the brightness is then adjusted to 50% backlight, the color temperature may be changed by the techniques discussed here to 4100K. Alternatively, in the last example, if a user chooses one or more input that cause the color temperature to change from 6500K to 4100K, the computer may automatically change the backlight from 25% to 50%. In this way, the brightness can be the dependent variable or the independent variable (as may the backlight intensity). Determinations about particular light values for various devices can be identified using the tools provided at www.fluxometer.com. For example, an iPad2 generates about 70 melanopic lux, though if an application is used to bring its overall color temperature to 2700K, it makes about 17, which is about the same that it makes if its brightness is dimmed to 24%.

Thus, the goal in such control may be to maintain an approximately constant melanopic lux level or constant level of a value that is equivalent to melanopic flux for characterizing the effect of light received by a user on the user's circadian pacemaker, as various parameters of a device are changed, where the changed parameters would otherwise change the melanopic lux level, potentially in a deleterious manner. The desired melanopic level is constant in response to changes in parameters (i.e., the change of one parameter from an outside influence may cause other parameters to change in a way that maintains a constant lux level) but may vary over time, such as by time of day or based on the level of excitation a user has been determined to have received during a day. For example, if it is determined that the user has been away from exciting blue light for a longer period than is typical for that user, with evening or a normal sleep time approaching, then a system may increase the level of melanopic lux it allows the user to receive as compared to a typical evening because such user is "underexposed" relative to acceptable levels. If, on the other hand, the user is determined to have "burned the midnight oil" by working on their computer constantly through the evening, the computer's colors may be shifted more aggressively away from blue light so as to save as much of the user's ability to get to sleep as possible—though only limited saving may be possible by that point.

Other parameters may also be monitored. For example, a determination may be made about whether a user is indoors or outdoors (e.g., using a microphone to detect echoes or ambient noise, using GPS location as compared to maps data, or using a light sensor), and a determination may be made about changes in natural light the user is receiving (e.g., because the sun is moving through the sky or because clouds are blocking and unblocking the sun).

In these manners then, a user's visual stimulation from electronic devices can be controlled and can be adaptive as conditions around the user are determined to change. In particular, as one aspect of a device is adjusted, other aspects may be automatically adjusted in corresponding manners to achieve a defined and predetermined goal, such as minimizing the melanopic effect of the changes within acceptable boundaries (e.g., within a range of color temperatures that is determined to be not too offensive to the typical viewer).

Figure 2:
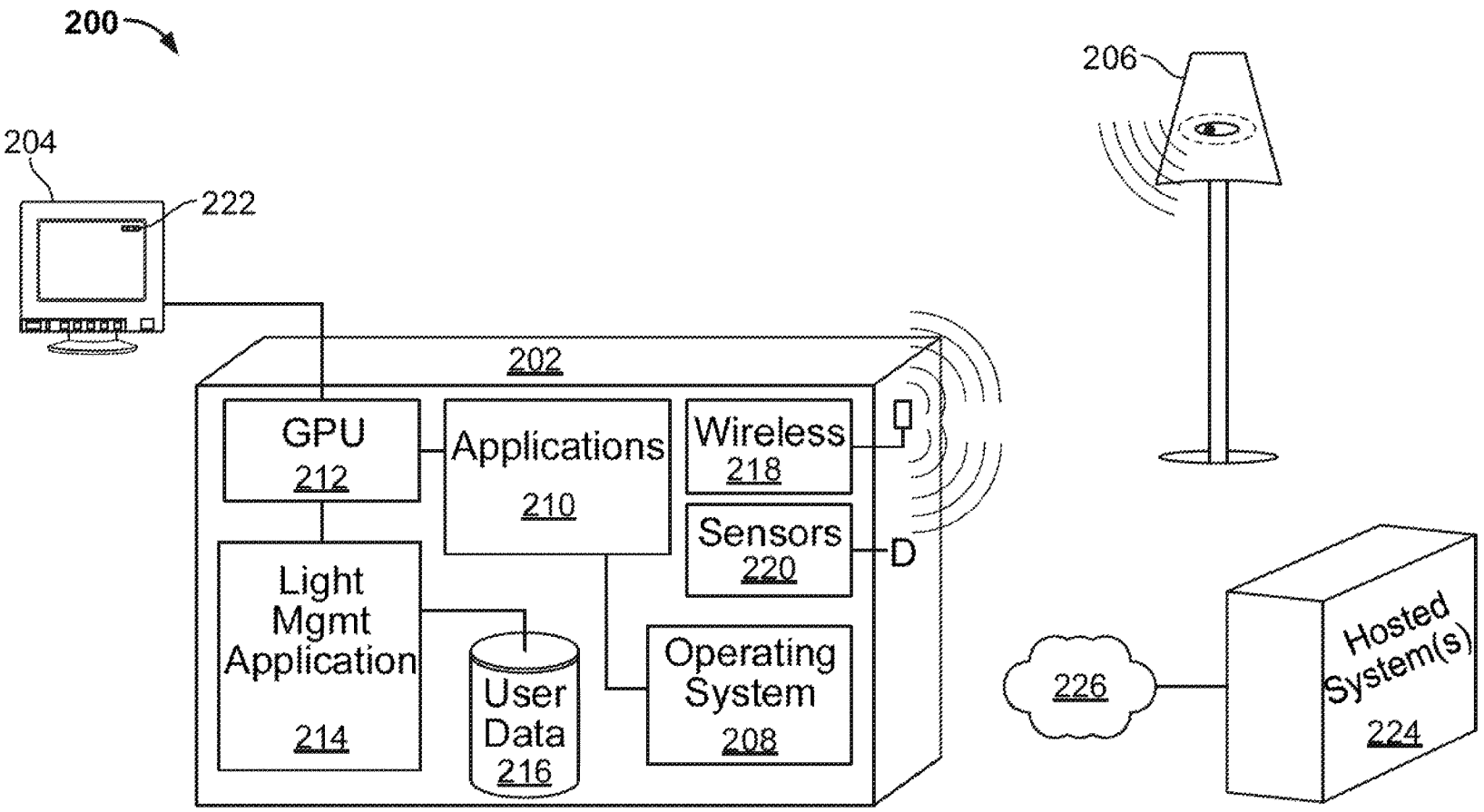
FIG. 2 is a block diagram of a system for controlling stimulating light that various light-generating appliances provide to a person.

FIG. 2 is a block diagram of a system 200 for controlling stimulating light that various light-generating appliances provide to a person. In general, the system 200 uses ordinary components of a computer system (e.g., a desktop, laptop, tablet, or smartphone computer or computers) programming to be operated in novel ways to adjust various parameters in response to sensed other parameters relating to stimulating light by the system 200 of a user.

The system 200 centers around a computer 202 that a user can employ in ordinary manners, e.g., for watching video, photo editing, business applications, web browsing, etc. The computer 202 in turn provides various forms of output (e.g., visual, audible, and haptic) via display 204, which may be in a separate housing from, or integrated as part of, computer 202. The display 204 may receive inputs from a microprocessor 210 executing applications on the computer 202, optionally through a graphical processing unit (GPU) 212.

An operating system 208 on the computer 202 manages the various operations of the computer 202, including the operation of the microprocessor 210 and GPU 212, and the ability of applications to be loaded and to execute on the computer 202, and also to interact with external resources like display 204, communication interfaces (e.g., to provide data to and receive data from the Internet), and other components. The operating system 208 may in particular provide drivers for components such as display 204, and among other things, can store and provide data for identifying characteristics of display 204, such as the make/model of display 204, so that, as appropriate, parameters of display or other components can be determined, such as to determine the amount of visual stimulation that display 204 provides under particular scenarios.

Light management application 214 may be one of the applications executed by microprocessor 210 and may adjust one or more parameters of display 204 in order to control the level of stimulating light that a user of computer 202 receives from display 204. Light management application 214 may have a variety of goals, including to lessen the amount of visual stimulation a user receives later in a day, so as to reduce interference with the user's natural sleep patterns from being exposed to light from display 204. Light management application 214 may be provided with data about a model that explains how display 204 delivers light to a user, data that indicates past exposure of the user to light (e.g., how long the user has been using computer 204 and other devices in the last X hours), data about other light sources that have been faced by or are being faced by the user, and other information. The various pieces of data may be obtained from third-party sources, as discussed below, such as via wireless interface 218, which may make a data connection to local appliances to obtain information about their delivery of light to the user, and to one or more networks such as the internet, so as to obtain other relevant data, and via sensors 220.

The light management application 214 can affect the output of display 204 by sending commands to the GPU 212 through an appropriate application programming interface (API). For example, the light management application 214 may use the operating system 208 to send commands to the GPU 212 to cause it to change the overall color temperature of content that is sent to the GPU 212 and provided for display 204, where the GPU 212 may implement a discrete shift it color temperature as compared to what it was doing before receiving the commands. As one example, the OpenGL API may be implemented by the GPU 212, and control of the overall color temperature (and adjustments to meet changes in overall color temperature) can be made by providing appropriate inputs for system color calibration controls, pixel shaders or other compositor-enabled techniques, or backlight controls (which may include color, e.g., for RGB/OLED displays). The appropriate mechanisms for causing adjustments in overall color temperature may differ from device-to-device and can be selected from among multiple possible techniques in response to determining a make and model for the device (e.g., via acquiring a device ID) and by providing appropriate parameters and/or software to execute on a particular device to carry out the adjustments.

The light management application 214 may take into account data generated both internal to computer 202 and external to computer 202, in determining one or more parameters to change via GPU 212. For internal data, light management application 214 may obtain data from user data database 216, such as data that indicate user preferences for display 204 (e.g., preferred brightness and color temperature settings, colors to be used for windows and other display elements as part of a profile, etc.), data that indicates a history of use by the user so as to enable computation of a total amount of stimulating light received by the user, and other similar data. The internal data may also include data generated by sensors 220 either at the behest of light management application 214 or another application, such as light sensor readings to determine the level of ambient light a user is being subjected to, orientation of the computer 202 and motion of the computer 202 to determine whether the user is holding the computer 202 (e.g., perhaps close to their face) or instead that the computer is resting on a desktop (e.g., and thus perhaps farther from the user's face so that the user is receiving less stimulating light). Other external data may be obtained via interface 216, such as from third-party data providers 224 via a network such as the Internet 226. For example, certain of the user data may be stored "in the cloud" and accessed by computer 202 from there. Also, data not easily obtainable directly by computer 202 may be obtained, including maps data that may indicate whether a building is present at the computer's current geographic location (so that ambient light would be adjusted accordingly by light management application 214), weather data to indicate likely ambient outdoor light levels at a particular geographic location and at a particular date and time, modeling information that indicates stimulating light levels provided by various makes and models of displays, and other such data.

Another appliance 206 local to the computer 202 may also communicate with the computer 202, such as by reporting its model and make, and its on or off status—and may also be controlled by computer 202. For example, a lamp may communicate with a home automation system which may in turn communicate with computer 202 so as to report that the lamp is currently on, so the light management application 214 may take such artificial light source into account in determining a degree of stimulating light in a room. Similarly, if computer 202 determines that total non-visual brightness is excessive in the room for residents of the room to get proper sleep, computer 202 may send a command, either directly or indirectly to lamp 206, to change the color temperature of the light being emitted from lamp 206, so as to obtain a non-visual brightness level that is more in line with good sleep for a user.

Light management application 214 may also cause content 222 to be generated on display 204 that informs a user of the status of light management for the answer, in addition to simply affecting display parameters for display 204. For example, an indication may be provided to a user with content 222 that indicates where they currently stand with respect to stimulating light and their ability to get to sleep readily—e.g., a red, yellow or green dot representing that they have gotten too much stimulation, almost too much, or not too much, respectively. More detail may also be provided, such as numeric and/or textual information that displays an amount by which a user has received too much visual stimulation for adequate sleep, and text that provides the user with tips for improving their situation—e.g., "Would you like me to adjust the brightness so that you can get better sleep tonight? (Y/N)."

The system 200 may also be arranged to carry out a number of related activities. For example, as noted, a hosted system 224 may be accessed over the Internet to obtain data that characterizes the amount of melanopic stimulating light that particular makes and models of displays provide to users. Such models may express the excitation on a per-pixel basis of per-group-of-pixels basis, and the light management application 214 can combine such a model with information (e.g., received from GPU 212) about the content that is being and has been provided to display 204 so as to characterize the overall light emitted over time from display 204 to a user of the computer 202.

In another example, the computer 202 may serve to compute an accumulation of visual stimulation for a user over the course of a particular time period, such as over the course of a day or over the course of a predefined number of hours before the user's scheduled time to go to bed. In particular, the computer 202 may sum natural light, artificial ambient light, and artificial point light that the user receives over the course of a day. For example, the computer 202 or another device or devices that accompany the user during a day can measure light received by a user or can infer such light. Measurement can be determined using a light sensor on a device that the user carries, whereas inference may be made by determining a user's immediate ambient environment (e.g., inside or outside) via sound measurement or comparison of the user's location to maps and satellite data that indicates the presence of buildings and/or plant cover at the user's particular geographic location. Assumptions may be made, for example, about typical office lighting levels and types if the user is determined to have spent part of her day in an office building.

Figure 3:
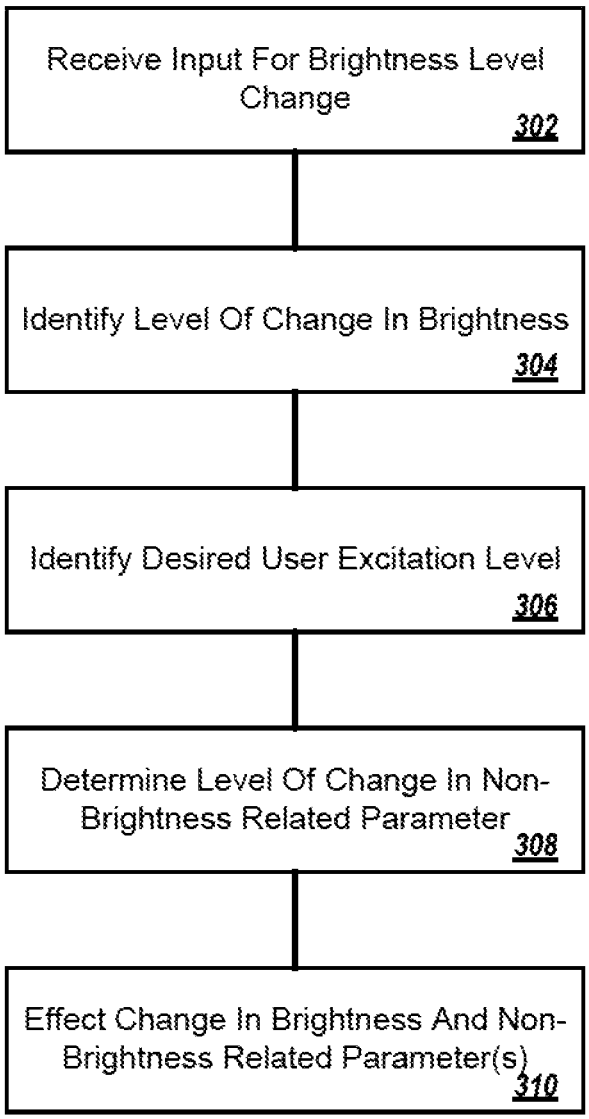
FIG. 3 is a flow diagram showing an example process for coordinated adjustment of multiple parameters for light generation.

FIG. 3 is a flow diagram showing an example process for coordinated adjustment of multiple parameters for light generation. In general, the process involves monitoring the environment around a user to identifying when a change in excitation level for the user has or is about to occur, and then adjusting other factors in the user's area to make up for the change.

The process begins at box 302, where input is received for a brightness-level change to the display of a computing device or other light-generating appliance. Such input may be manual, such as from a user adjusting a brightness level, or may be manual, such as by a system sensing a reduction in ambient brightness (e.g., because the lights in a room have been turned off) and then adjusting brightness of a device like a tablet computer downward accordingly so that the device does not throw out an uncomfortably high level of light for a user. The sensing of such change may be of a change that has already occurred or a change that will very soon occur (e.g., where an about-to-change brightness is determined, related changes are determined, and all the changes are then effected in combination).

At box 304, the level of the brightness change is determined. The level may be identified in a variety of ways, including average photopic lux for the display. Such a change may also be translated into other terms so as to reflect a melanopic-related effect that the change in brightness will be expected to have on a user of the device. For example, a melanopic lux level can be determined, and can be adjusted to be X percent lower, with a goal of reducing absolute melanopic lux below a threshold level. The change in brightness may also be correlated to a model for a particular display, which model represents the amount of stimulating light created by a pixel for a particular brightness level and particular output color from a color palette.

At box 306, a desired level of user stimulating light may be determined. For example, a total level of excitation from a device display may be predetermined and set to not be exceeded, or a maximum level for ambient (natural and artificial) and device-originated lighting may be set. The desired maximum level may also change over time, and may be a function of the amount of excitation the user has received in a recent time period, a time until the user is expected to go to bed, and the total level of excitation determined to be allowable with the user without substantially affecting the user's ability to sleep (e.g. to not delay sleep of the average user by a set time period such as more than 5, 10, 15, 20, 25, 30, 45, or 60 minutes).

At box 308, the process determines a level of change to be made in a non-brightness parameter, so as to make up for the change in brightness level. And at box 310, a change in brightness and non-brightness related parameter or parameters is effected. For example, an increase in brightness will generally result in an increase in melanopic-affecting stimulating light for a user, and that increase can be offset by a change in overall color temperature for the display that is relatively warmer in temperature (e.g., a shift to the red end of the color spectrum). For example, a model for the particular display may include a table or other mechanism that associates brightness levels with color temperature levels with melanopic effect. The table may be traversed using prior and subsequent values for the lighting level, in order to find a color temperature level that will keep the melanopic effect of the display constant.

The determination of a goal for a parameter may be made by assuming a bedtime for the user. Such an assumed bed time may have been input explicitly by the user, such as for the particular day, or a general bedtime when the user has not overridden it with a bedtime for the particular day. A user may also establish a schedule whereby bedtimes are different for different days of the week—e.g., earlier for weeknights and later for weekends. The assumed bedtimes may also be inferred by the system, such as by monitoring when a user stops and starts using a mobile device in the evening and morning over a period of time, and setting an assumed bedtime slightly after the average last use. Similarly, user activity can be inferred in familiar manners using a wearable, such as a watch or fitness wristband. Bedtimes may also be assigned based on a known chronotype for a user (e.g., early bird, night owl, etc.), where the chronotype may be explicitly identified by the user or inferred via observation of user activity. Moreover, a bedtime can be set, or can be affected for a particular day, by information in a user's electronic calendar, such as moving a normal 10 p.m. bed time to midnight where the user's calendar indicates that the user will be in a meeting or attending a sporting or music event, and will not return home until around midnight (perhaps setting the bedtime to one hour after the expected end of the event to permit commuting time, and time getting ready for bed). Such determinations may be made by communicating (e.g., thorough a public API) with a more general platform for inferring future user activity, such as the GOOGLE NOW platform, and information may be provided by a light excitation tracking application to such a platform, for it to be used by other applications.

In other implementations, multiple parameters may be changed in response to identifying a change in brightness level (or other independent variable), and they may be adjusted for reasons other than maintaining a constant melanopic effect for the display. For example, an increase in brightness may be identified, and in response, the color temperature may be warmed to maintain a melanopic effect, and the frame rate for a movie of videogame may be lowered so as to lessen the load on a GPU, which lower load may lower electrical consumption by a GPU in order to offset a presumed increase in electrical use by the display because of the increase in brightness.

Limits may be set on the changes also. For example, a maximum color temperature level may be set that represents a limit beyond which a display may look unnatural to a user, and a color temperature may be "pegged" to that level (and not allowed to go beyond it) even if the change does not fully offset the melanopic effect of a change in brightness. In such a situation, a message may be presented to a user warning them that the change in brightness will adversely affect their ability to get to sleep, so that they can re-adjust the brightness or shorten the amount of time they spend with their device for the remainder of the day. Also, in certain situations, the ambient room lighting may have such a large melanopic effect on a user that a device like a computer display cannot be adjusted to address the problem; in such a situation, the user may be instructed to adjust the ambient lighting in a particular manner so as to achieve a more desirable melanopic effect for the user. In a broader situation, a user may perform a lighting "audit" of all the spaces they inhabit—e.g., by taking a computer from room to room, setting normal lighting for the room (perhaps at different times of day), and then being instructed by the computer about the ambient lighting situation in each space, with recommendations on how to improve the ambient lighting situation so that the user can reduce melanopic disruption caused by the ambient lighting.

In certain situations, the determined level of change in the second parameter may be a function of a determined amount of usage of the device that is expected by the user in the remainder of the day. For example, usage logs may be kept for a user, and such logs may indicate that on weeknights, the user does not employ their mobile computer from 7p.m. to 9p.m., perhaps because that represents a time when the user is putting her children to sleep. Such information may be used to create an assumption, for example, at 6p.m. on a weeknight, that the user's device usage will only be from 6-7 p.m. and 9-11 p.m., which is the user's expect bedtime, and not from 7-9 p.m.

In certain situations the rate of change in brightness or the non-brightness parameter can be varied based, e.g., on whether the parameter is being increased or decreased. For example, increases in brightness may be considered to be more jarring to a user than decreases, so that the rate of change applied when increasing brightness may be slower than the rate when decreasing brightness—with the goal being to not interfere with a user's continuing work when the changes are made.

Notably, the discussion here about changes in color temperature and brightness level are for the display itself, rather than for particular items of content displayed on the display. In other words, a display will brighten if it is playing a movie, and the scene shifts from indoors to sunny outdoors. The change in brightness or color temperature here refers, not to the natural change in the content itself, but to changes between watching particular content at one setting level as opposed to watching it at a different setting level for the various relevant parameters.

Figure 4:
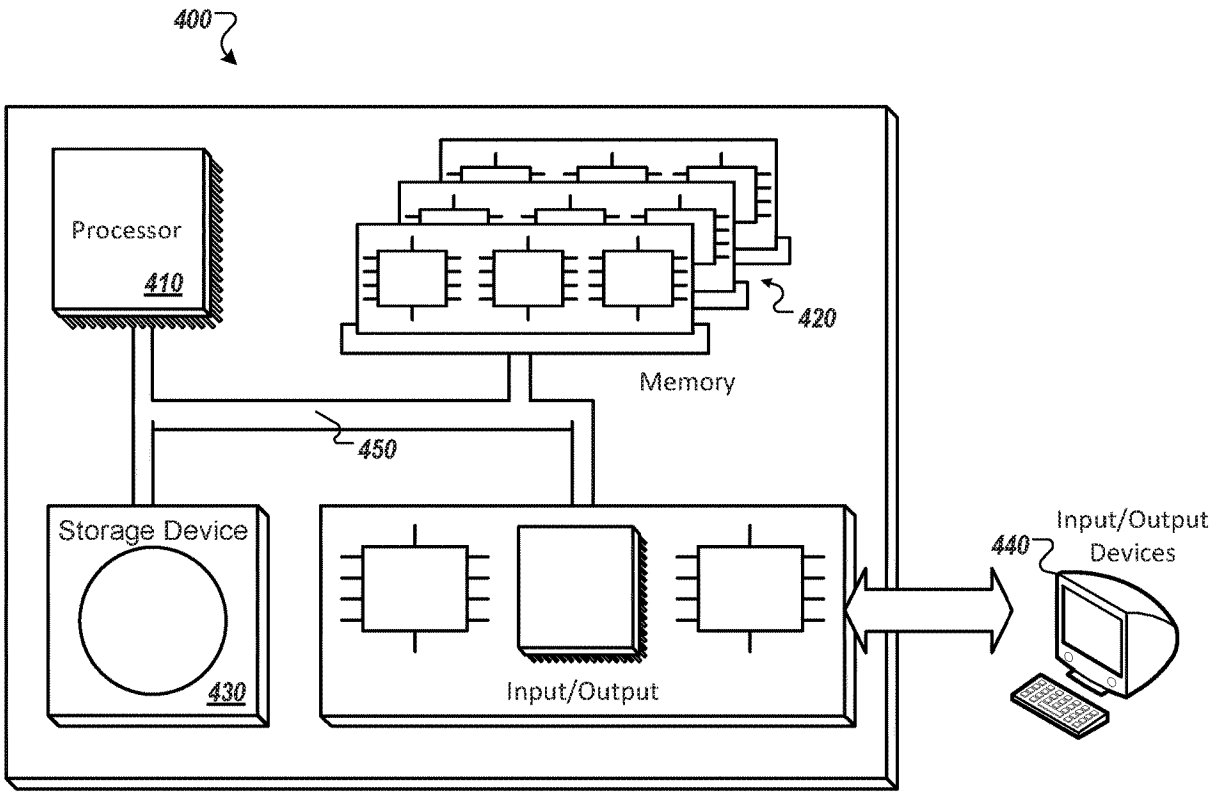
FIG. 4 is a schematic diagram of a computer system.

FIG. 4 is a schematic diagram of a computer system 400. The system 400 can be used to carry out the operations described in association with any of the computer-implemented methods described previously, according to one implementation. The system 400 is intended to include various forms of digital computers, such as laptops, desktops, workstations, personal digital assistants, servers, blade servers, mainframes, and other appropriate computers. The system 400 can also include mobile devices, such as personal digital assistants, cellular telephones, smartphones, and other similar computing devices. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The system 400 includes a processor 410, a memory 420, a storage device 430, and an input/output device 440. Each of the components 410, 420, 430, and 440 are interconnected using a system bus 450. The processor 410 is capable of processing instructions for execution within the system 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the system 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the system 400. In one implementation, the storage device 430 is a computer-readable medium. In various different implementations, the storage device 430 may be a floppy disk device, a hard disk device, an optical disk device, or a tape device.

The input/output device 440 provides input/output operations for the system 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

The computer system can include clients and servers. A client and server are generally remote from each other and typically interact through a network, such as the described one. The relationship of client and server arises by virtue of computer programs running on the respective computers and having a client-server relationship to each other.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A computer-implemented method for controlling display of a light-generating appliance, the method comprising:

identifying a change in a first parameter for light delivered by the light-generating appliance, the identifying of the change being caused by an input external to the light-generating appliance;

determining, automatically with a component of the light-generating appliance and in response to identifying the change in the first parameter, a level of change to be made in a second parameter for light delivered by the light-generating appliance, wherein a direction of the change and amount of the change in the second parameter are selected so as to offset a change in circadian stimulation to a user of the device that results from the change in the first parameter, and wherein one of the first and second parameters is brightness and an other of the first and second parameter comprises a non-brightness parameter; and changing the second parameter based on the determined level of change to be made in the second parameter, in association with the change of the first parameter, wherein the offset comprises (a) decreasing color temperature value in response to an increase in brightness, (b) decreasing brightness in response to an increase in color temperature value, (c) increasing color temperature value in response to a decrease in brightness, or (d) increasing brightness in response to a decrease in color temperature value.

2. The computer-implemented method of claim 1, wherein the change to be made in the first parameter is identified in response to a manual user input to change a brightness level of the light-generating appliance.

3. The computer-implemented method of claim 1, wherein the change to be made in the first parameter is identified from an ambient brightness level sensed by a sensor of the light-generating appliance.

4. The computer-implemented method of claim 1, wherein the light-generating appliance comprises a display of a computer and the first or second parameter is an overall color temperature level of the display.

5. The computer-implemented method of claim 4, wherein the change to be made in the first parameter is identified in response to determining that a particular type of software application is, or is going to be, a focus on the display.

6. The computer-implemented method of claim 4, wherein the level of change to be made in the overall color temperature level of the display is a function of an amount of stimulating light that a user of the electronic device has been determined to have received during a current day.

7. The computer-implemented method of claim 1, further comprising determining an amount of stimulating light that the user of the light-generating appliance has received during the current day, including stimulating light from the light-generating appliance and stimulating light from sources other than the light-generating appliance.

8. The computer-implemented method of claim 7, wherein the light-generating appliance is a computer and the sources other than the light-generating appliance comprise natural and artificial ambient light sources.

9. The computer-implemented method of claim 8, wherein light from the natural and artificial ambient light sources is sensed by a sensor that is part of the computer.

10. The computer-implemented method of claim 9, wherein the computer makes a determination whether an ambient light source is natural or artificial by analyzing one or more characteristics of the light sensed by the sensor, and provides a result of the determination to a sub-system for determining the level of change to be made in an overall color temperature level of a display of the computer.

11. The computer-implemented method of claim 1, wherein the light-generating appliance comprises a computer display, and as a result of determining that a brightness level of the computer display has gotten brighter, changing an overall color temperature of the computer display to a warmer color temperature than it was before the change to be made in the brightness level was identified.

12. The computer-implemented method of claim 11, further comprising selecting a speed, from multiple available speeds, with which the change in brightness level is made.

13. The computer-implemented method of claim 12, wherein speeds selected for dimming the display are faster than speeds selected for brightening the display.

14. The computer-implemented method of claim 11, where the determined level of change to be made in the overall color temperature of the display is made using a numeric model of a manner in which the display provides stimulating light to viewers of the display.

15. The computer-implemented method of claim 11, wherein the change to be made in the second parameter is selected to exactly cancel the change in level of circadian stimulation from the change in the first parameter.

16. The computer-implemented method of claim 1, further comprising:

identifying a change to be made in a brightness level of a second light-generating appliance associated with a user who is different than the user in the presence of the light-generating appliance;

determining a level of change to be made in a nonbrightness-related lighting output parameter of the second light-generating appliance, to achieve a desired level of user stimulating light for a user visually exposed to the second light-generating appliance; and changing the brightness level of the second light-generating appliance according to the identified change in the brightness level and changing the nonbrightness-related lighting output parameter based on the determined level of change to be made in the nonbrightness-related lighting output parameter.

17. The computer-implemented method of claim 16, wherein the user and the second user are in the same physical space and exposed to the same ambient light.

18. One or more tangible, non-transitory machine-readable media having recorded thereon instructions, that when executed by one or more processors, perform operations that comprise:

identifying a change in a first parameter for light delivered by a light-generating appliance, the identifying of the change being caused by an input external to the light-generating appliance;

determining, automatically with a component of the light-generating appliance and in response to identifying the change in the first parameter, a level of change to be made in a second parameter for light delivered by the light-generating appliance, wherein a direction of the change and amount of the change in the second parameter are selected so as to offset a change in circadian stimulation to a user of the device that results from the change in the first parameter, and wherein one of the first and second parameters is brightness and an other of the first and second parameters comprises a non-brightness parameter; and changing the second parameter based on the determined level of change to be made in the second parameter, in association with the change to the first parameter, wherein the offset comprises (a) decreasing color temperature value in response to an increase in brightness, (b) decreasing brightness in response to an increase in color temperature value, (c) increasing color temperature value in response to a decrease in brightness, or (d) increasing brightness in response to a decrease in color temperature value.

19. The tangible, non-transitory machine-readable media of claim 18, wherein the change to be made in the first parameter is identified in response to a manual user input to change the first parameter of the light-generating appliance.

20. The tangible, non-transitory machine-readable media of claim 18, wherein the change to be made in the first parameter is identified from an ambient value sensed by a sensor of the light-generating appliance.

21. The tangible, non-transitory machine-readable media of claim 18, wherein the light-generating appliance comprises a display of a computer and the first or second parameter is an overall color temperature of the display.

22. The tangible, non-transitory machine-readable media of claim 21, wherein the change to be made in the first parameter is identified in response to determining that a particular type of software application is, or is going to be, a focus on the display.

23. The tangible, non-transitory machine-readable media of claim 21, wherein the level of change to be made in the overall color temperature level of the display is a function of an amount of stimulating light that a user of the electronic device has been determined to have received during a current day.

24. The tangible, non-transitory machine-readable media of claim 18, wherein an amount of stimulating light that the user of the light-generating appliance has been determined to have received during the current day comprises stimulating light from the light-generating appliance and stimulating light from sources other than the light-generating appliance.

25. The tangible, non-transitory machine-readable media of claim 24, wherein the light-generating appliance is a computer and the sources other than the light-generating appliance comprise natural and artificial ambient light sources.

26. The tangible, non-transitory machine-readable media of claim 25, wherein the light from the natural and artificial ambient light sources is sensed by a sensor that is part of the computer.

27. The tangible, non-transitory machine-readable media of claim 26, wherein the computer makes a determination whether an ambient light source is natural or artificial by analyzing one or more characteristics of the light sensed by the sensor, and provides a result of the determination to a sub-system for determining the level of change to be made in the overall color temperature level of a display of the computer.

28. The tangible, non-transitory machine-readable media of claim 18, wherein the light-generating appliance comprises a computer display, and as a result of determining that the brightness level of the computer display has gotten brighter, changing an overall color temperature of the computer display to a warmer color temperature than before the change to be made in the brightness level was identified.

29. The tangible, non-transitory machine-readable media of claim 28, wherein the operations further comprise selecting a speed, from multiple available speeds, with which the change in brightness level is made.

30. The tangible, non-transitory machine-readable media of claim 29, wherein speeds selected for dimming the computer display are faster than speeds selected for brightening the computer display.

31. The tangible, non-transitory machine-readable media of claim 28, wherein the determined level of change to be made in the overall color temperature of the computer display is made using a numeric model of a manner in which the computer display provides stimulating light to viewers of the computer display.

32. The tangible, non-transitory machine-readable media of claim 28, wherein the change to be made in brightness level is determined by the computer as a function of the level of change to be made in the overall color temperature of the computer display.

33. The tangible, non-transitory machine-readable media of claim 18, wherein the operations further comprise:

identifying a change to be made in a brightness level of a second light-generating appliance associated with a user who is different than the user in the presence of the light-generating appliance;

determining a level of change to be made in a nonbrightness-related lighting output parameter of the second light-generating appliance, to achieve a desired level of user stimulating light for a user visually exposed to the second light-generating appliance; and changing the brightness level of the second light-generating appliance according to the identified change in the brightness level and changing the nonbrightness-related lighting output parameter based on the determined level of change to be made in the nonbrightness-related lighting output parameter.

* * * * *